US009741269B2

(12) United States Patent
Ellingson

(10) Patent No.: US 9,741,269 B2
(45) Date of Patent: Aug. 22, 2017

(54) MODULAR SIGNPOST SYSTEM

(71) Applicant: Sign Post Solutions, LLC, Atlanta, GA (US)

(72) Inventor: Robert T. Ellingson, Social Circle, GA (US)

(73) Assignee: Sign Post Solutions, LLC, Atlanta, GA (US)

( * ) Notice: Subject to any disclaimer, the term of this patent is extended or adjusted under 35 U.S.C. 154(b) by 0 days.

(21) Appl. No.: 14/960,489

(22) Filed: Dec. 7, 2015

(65) Prior Publication Data

US 2017/0162085 A1 Jun. 8, 2017

(51) Int. Cl.

| | |
|---|---|
| ***G09F 15/00*** | (2006.01) |
| ***G09F 7/20*** | (2006.01) |
| ***G09F 7/18*** | (2006.01) |
| ***E04H 17/14*** | (2006.01) |

(52) U.S. Cl.

CPC ..... *G09F 7/20* (2013.01); *E04H 17/1413* (2013.01); *E04H 17/1417* (2013.01); *E04H 17/1439* (2013.01); *E04H 17/1443* (2013.01); *G09F 7/18* (2013.01); *E04H 2017/1465* (2013.01); *G09F 2007/1804* (2013.01); *G09F 2007/1847* (2013.01); *Y10T 403/55* (2015.01)

(58) Field of Classification Search

CPC ..... E04H 17/1413; E04H 17/1417; E04H 17/1421; E04H 17/1404; E04H 17/1439; E04H 17/1443; E04H 2017/1465; Y10T 403/55

USPC ..... 248/159, 156, 121, 219.3; 40/607.06; 403/292, 317, 346

See application file for complete search history.

(56) References Cited

U.S. PATENT DOCUMENTS 152,153 A * 6/1874 Mott ..... H01R 4/186 174/133 R
170,377 A * 11/1875 Johnson ..... F16L 13/141 15/145
470,514 A * 3/1892 Simpson ..... F16L 13/146 135/114

(Continued)

OTHER PUBLICATIONS

Sams Signs, Sam's Real Estate Post, Feb. 2013, accessible at http://www.samsign.com/product/sams-real-estate-post/.

*Primary Examiner* — Kimberly Wood
(74) *Attorney, Agent, or Firm* — Smith Tempel Blaha LLC; Matthew T. Hoots

(57) ABSTRACT

An improved system for simply assembling, installing, and customizing a signpost. In one exemplary embodiment, the assembled signpost may define a semi-modular post-with-arm structure configured to receive one or more signs via one or more attachment components. The attachment component(s) may be adjustably attached/positioned at any length along the extended arm component. Moreover, the extended arm component, and any signs engaged thereto, may be supported by the post component. Moreover, the post component, the extended arm component, and any signs engaged thereto, may be rigidly yet detachably engaged to a supporting substrate via an anchoring component. The anchoring component may be specifically designed to engage discreetly with the supporting substrate under cover of the post component. Moreover, the assembled signpost may comprise a decorative add-on sub-system intended to make the over-all system more aesthetically pleasing to the intended audience.

4 Claims, 8 Drawing Sheets

(56) References Cited

U.S. PATENT DOCUMENTS 1,051,427 A * 1/1913 McCluskey ..... F16L 37/0925 242/118.41
1,788,096 A * 1/1931 Friedemann ..... A47F 5/04 108/96
1,857,314 A * 5/1932 Markman ..... E01F 9/615 248/219.3
2,591,346 A * 4/1952 Fitzgerald ..... E06B 9/01 403/346
3,285,554 A * 11/1966 Voelkerding ..... E01F 9/685 211/196
3,476,413 A * 11/1969 Brown ..... F16L 13/004 285/332.3
3,671,062 A * 6/1972 Ashworth ..... F16B 7/0413 403/292
3,697,028 A * 10/1972 Nimmo ..... F16B 2/06 108/158.11
3,698,564 A * 10/1972 Muller ..... A47B 96/145 211/119.003
3,759,623 A * 9/1973 Hesse ..... F16B 7/0413 248/159
3,995,796 A * 12/1976 Kline ..... A45F 3/44 248/121
4,249,715 A * 2/1981 Repp ..... E01F 9/685 248/156
4,258,494 A * 3/1981 Borque ..... G09F 7/18 40/606.19
4,279,104 A * 7/1981 Classen ..... E01F 9/685 52/165
4,326,352 A * 4/1982 Barth ..... E01F 9/623 248/156
4,327,514 A * 5/1982 Bourque ..... G09F 7/18 40/606.19
4,357,772 A * 11/1982 Amick ..... G09F 7/18 248/159
4,441,679 A * 4/1984 Calet ..... E04H 12/223 248/156
4,483,506 A * 11/1984 Litwiller ..... E01F 9/685 248/156
4,524,533 A * 6/1985 Still, Jr. ..... G09F 7/18 248/156
4,548,327 A * 10/1985 Kilkelly ..... A47B 81/002 108/152
4,570,408 A * 2/1986 Frascaroli ..... E04B 1/5831 403/176
4,691,818 A * 9/1987 Weber ..... B65G 33/32 198/666
4,843,746 A * 7/1989 DesNoyers ..... G09F 7/18 248/156
5,144,780 A * 9/1992 Gieling ..... E04B 1/5831 135/114
5,203,135 A * 4/1993 Bastian ..... F16B 7/0413 403/292
5,454,548 A * 10/1995 Moore ..... E04H 17/1443 256/22
5,833,181 A * 11/1998 DesNoyers ..... E04H 12/2215 248/156
5,903,991 A * 5/1999 Sasse ..... G09F 7/22 248/156
6,036,147 A * 3/2000 Militzer ..... A61M 5/1415 248/125.8
6,575,423 B2 * 6/2003 Erwin ..... A47G 29/1216 248/121
7,089,694 B2 * 8/2006 Allen ..... G09F 15/0037 173/126
7,832,180 B2 * 11/2010 Dolby ..... E04B 2/96 52/235
D641,793 S * 7/2011 Dumontier ..... D20/41
8,506,206 B2 * 8/2013 Desmeules ..... E02D 5/285 403/292
9,262,948 B2 * 2/2016 Pounders ..... G09F 15/0018
2004/0206860 A1 * 10/2004 Bolinder ..... E04H 12/2215 248/156
2005/0127344 A1 * 6/2005 Graber ..... E04H 17/1443 256/22
2006/0016111 A1 * 1/2006 Simmons ..... G09F 7/22 40/607.04
2006/0185203 A1 * 8/2006 Bittle ..... G09F 7/20 40/541
2007/0296208 A1 * 12/2007 Leblanc ..... F16L 1/10 285/31
2008/0156957 A1 * 7/2008 Nervi ..... G09F 7/22 248/530
2011/0308990 A1 * 12/2011 Pounders ..... E04H 12/2215 206/525
2014/0345176 A1 * 11/2014 Okert ..... G09F 7/22 40/606.03

* cited by examiner

MODULAR SIGNPOST SYSTEM

DESCRIPTION OF THE RELATED ART

Traditional signposts, like those assembled and installed for ubiquitous real estate "FOR SALE" signs, are used for multiple and simultaneous operations. As in many designs, in order to maximize the functionality of one operation there is often a concomitant reduction in the functionality of another operation.

For example, in order to securely hold a sufficiently large/visible sign, it is preferable to have an assembled signpost that is sufficiently sized and sufficiently tall. Moreover, it is preferable that the signpost be strongly engaged with the supporting substrate. However, in order to effectively and efficiently assemble and install a signpost, it is preferable to have an assembled signpost that is comprising lightweight and easy-to-manipulate component pieces, and that is configured for detachable engagement from the supporting substrate.

Furthermore, in order to augment the advertising function of any attached sign, it is preferable to have an assembled signpost that is aesthetically pleasing to the intended audience. This is, for example, accomplished via an assembled signpost that is comprising classic/modern ornamental features and designs, and that is manufactured from traditional materials like carved wood or smithed metal. However, in order to have an assembled signpost that is affordable and useful under various circumstances, it is preferable to have an assembled signpost that is comprising simply shaped component pieces, and that is manufactured from affordable composite and/or synthetic materials.

Furthermore, and related to the above, in order to maximize the aesthetically pleasing qualities of the signpost while holding a sign, it is preferable to have an assembled signpost that appears custom-built and intended for that specific sign. This is, for example, accomplished via an assembled signpost that is specifically sized to match the dimensions of that sign such that the specific sign is not off-center, crooked, or awkwardly positioned. However, in order to have an assembled signpost that is useful under various circumstances, it is preferable to have an assembled signpost that is easily customizable for various types, configurations and combinations of signs.

There is, therefore, a need in the art for a signpost system that can balance competing functions. Accordingly, there is now provided within this disclosure an improved system for simply assembling, installing, and customizing a signpost, which effectively overcomes the aforementioned difficulties and longstanding problems inherent in the art.

SUMMARY OF THE DISCLOSURE

Briefly, the present disclosure is related to an improved system for simply assembling, installing, and customizing a signpost. In one exemplary embodiment of the system, the signpost system comprises a sign attachment component, an extended arm component, a post component, and an engagement key.

More specifically, in this exemplary embodiment, the extended arm component defines a surface feature configured to receive the sign attachment component such that the relative position of the sign attachment component is adjustable along a length of the extended arm component. In this way, the position of any signage held by the signpost is adjustable relative to the extended arm component.

Furthermore, in this exemplary embodiment, the post component defines a hollow interior and is configured to receive a traversing portion of the extended arm component into the hollow interior. Because the traversing portion of the extended arm component defines an engagement slot, the engagement slot is positioned within the hollow interior of the post component. In this way, any engagement of the extended arm component and the post component may be accomplished from within the hollow interior.

Furthermore, in this exemplary embodiment, the engagement key comprises an engagement end and a retention end. The engagement end is configured to cooperate with the engagement slot within the hollow interior. In this way, the engagement key cooperating with the engagement slot may detachably engage the extended arm component with the post component.

Furthermore, in this exemplary embodiment, when the post component receives the traversing portion of the extended arm component, and when the engagement end cooperates with the engagement slot within the hollow interior, the post component supports the extended arm component. Moreover, the retention end prevents the traversing portion of the extended arm component from displacing relative to the post component, despite relatively heavy loads.

This summary is provided to introduce a selection of concepts that are further described below in the detailed description. This summary is not intended to identify key or essential features of the claimed subject matter, nor is it intended to be used as an aid in limiting the scope of the claimed subject matter.

BRIEF DESCRIPTION OF THE DRAWINGS

In the Figures, like reference numerals refer to like parts throughout the various views unless otherwise indicated. For reference numerals with letter character designations such as (102*a*) or (102*b*), or (102*a*') and (102*a*"), the letter character designations and/or "prime" or "double prime" designations may differentiate two like parts or elements present in the same Figure or suggest that additional like parts or elements not shown in the Figure may be envisioned. Letter character designations and/or "prime" or "double prime" designations for reference numerals may be omitted in the description of a Figure when it is intended that a reference numeral refer to a subsystem such that it encompasses all parts having the same reference numeral in all Figures.

DETAILED DESCRIPTION

Figure 1:
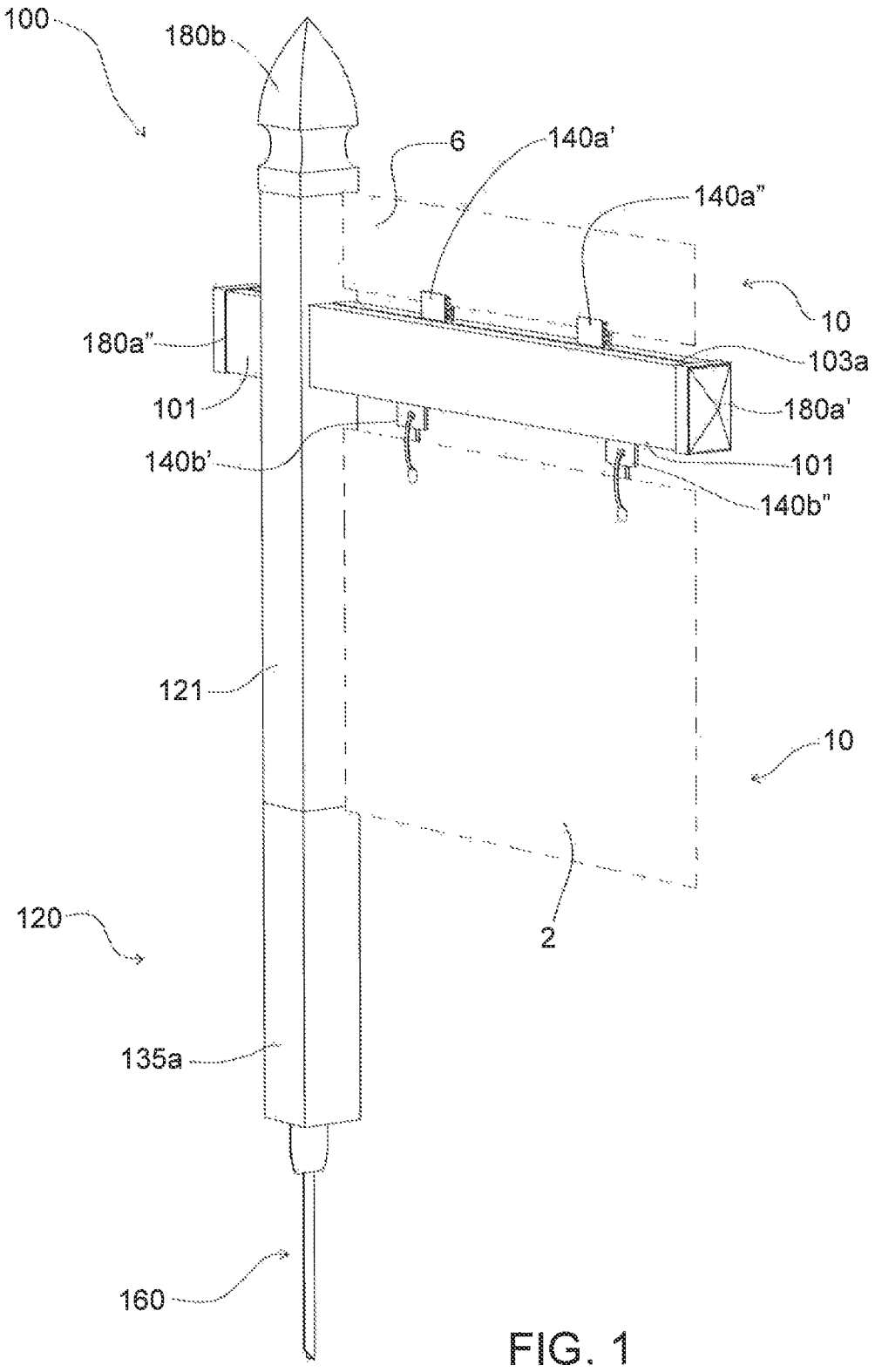
FIG. 1 is a perspective right side view of one exemplary embodiment of an assembled signpost of the present disclosure holding one exemplary embodiment of signage.

The term "exemplary" is used herein to mean "serving as an example, instance, or illustration." Any aspect described herein as "exemplary" is not necessarily to be construed as preferred or advantageous over other aspects.

The present disclosure is related to a system for simply assembling, installing, and customizing a signpost. In one exemplary embodiment of the system, one important aspect is the structural design of the assembled signpost. The structural design is simple, elegant, and stable, resulting from affordable, simple-to-manufacture, and user-friendly components/sub-systems that form a sturdy, stable, and scalable post-with-arm structure.

More specifically, each individual component/sub-system may have a structural design that serves a specific function, resulting in simplified manufacturing and simplified end-user use. Moreover, each individual component/sub-system may have minimal material costs, resulting in more simplified manufacturing. Moreover, each individual component/sub-system may have optimized dimensions, density and volume, resulting in more simplified manufacturing, and more simplified end-user use, and simplified shipping/storage. Moreover, each individual component/sub-system may allow for various ways-of-assembly with the other component(s)/subsystem(s), resulting in simplified and customized end-user use.

In another exemplary embodiment of the system, the assembled signpost may define a semi-modular post-with-arm structure. The extended arm component may be configured to receive one or more signs via one or more attachment components. The attachment component(s) may be adjustably attached/positioned at any length along the extended arm component such that any attached sign is not off-center, crooked, or awkwardly positioned off of the extended arm component. Moreover, the extended arm may be a modular sub-system comprising equally sized sub-attachment components. Additional sub-attachment components may be engaged to the extended arm component to increase or reduce its length.

Furthermore, the extended arm component, and any signs engaged thereto, may be supported by the post component. The post component may be configured to adjust the height of the extended arm component for the assembled signpost. The post component may be a modular sub-system comprising equally sized sub-post components. Additional sub-post components may be engaged to the post component to increase or reduce its length and, therefore, increase the height of the extended arm component. The post component may also be a mechanical subsystem configured to increase the height of the extended arm component without need for additional attachments.

Furthermore, the post component with the extended arm component may be configured to adjust the extension length of the arm off of the post, and/or adjust the shape of the overall post-with-arm structure. The junction between the extended arm component and the post component may have an adjustable angle. The junction between the extended arm component and the post component may also be adjustable such that the overall shape of the assembled signpost may vary along the spectrum defined by the ⌊-shape through the ⊥-shape through the ⌋-shape.

Furthermore, the post component, the extended arm component, and any signs engaged thereto, may be rigidly yet detachably engaged to a supporting substrate via an anchoring component. The anchoring component may be a simple-to-install, no-tools-required barb configured for insertion into the supporting substrate. A user may readily (using their own body weight, for example) engage the anchoring component with the supporting substrate. Moreover, so as to not complicate the design, manufacturing, or utility of the anchoring component, the anchoring component may be specifically designed to engage discreetly with the supporting substrate under cover of the post component. In this way, the post component and the majority of any other visible component may be manufactured from affordable composite and/or synthetic materials that may not be able to rigidly engage with the supporting substrate.

In another exemplary embodiment of the system, the assembled signpost may comprise a decorative add-on sub-system intended to make the over-all system more aesthetically pleasing to the intended audience. The decorative add-on sub-system may be shaped into classic/modern ornamental features and designs configured for attachment to the assembled sign post at any component.

Referring now to the drawings, wherein the showings are for purposes of illustrating certain exemplary embodiments of the present disclosure only, and not for purposes of limiting the same, FIG. 1 is a perspective right side view of one exemplary embodiment of an assembled signpost of the present disclosure holding one exemplary embodiment of signage. More specifically, signpost 100 is an assembled, modular post-with-arm structure holding signage 10 comprising one exemplary embodiment of a hanging panel sign 2 and a rider panel sign 6. The signage 10 may be any type of sign or grouping of signs (e.g., panel signs, neon signs, box lettering; hanging and riding) that would benefit from the support and positioning provided by an embodiment of an assembled signpost according to the present disclosure.

Consequently, the signpost 100 and/or any of its components/sub-systems may be scaled to various sizes and customized in shape/color/aesthetic appearance, based on the type of signage 10, the intended audience, and/or the intended goal for presenting the signage 10 in the first place. For example, the signpost 100 may be a real estate "FOR SALE" sign (sufficiently wide and tall to hold an appropriate sign that is visible from both sides of a nearby road, and sufficiently bright colored to facilitate catching the attention of the intended audience, for example), or the signpost 100 may be an understated business sign (sufficiently wide and tall to hold an appropriate sign that is visible to those specifically looking for the business, and sufficiently matching of any surrounding aesthetics to complement the architectural and design features inherently around it, for example). One of ordinary skill in the art understands that regardless of the specific type of signage, the present disclosure provides various inventive aspects and elements that are applicable to various disparate circumstances.

Furthermore, in the exemplary embodiment of FIG. 1, signpost 100 comprises one exemplary embodiment of an extended arm component 101, a semi-modular post sub-system 120, a sign attachment sub-system 140, an anchoring component 160, and a decorative add-on sub-system 180. One of ordinary skill in the art understands that the signpost 100 may comprise various other external or internal components/sub-systems that may include, but are not limited to, lights, wiring, extensions, etc.

More specifically, the extended arm component 101 is one exemplary embodiment of a horizontal panel arm. When assembled with the semi-modular post sub-system 120 (described in greater detail herein), the horizontal panel arm

101 extends laterally relative to the post sub-system 120 to define an angle of between about 85.00 degree and about 95.00 degrees, and preferably about 90.00 degrees. The extended arm component 101 is held in place and supported by the semi-modular post sub-system 120 (described in greater detail herein) such that the extended arm component 101 bears and translates its own weight and the weight of any signage 10. Moreover, the extended arm component 101 is held in place and supported by the semi-modular post sub-system 120 such that the assembled signpost 100 defines/retains an ⌊-shape despite any heavy loads or external forces.

Figure 2:
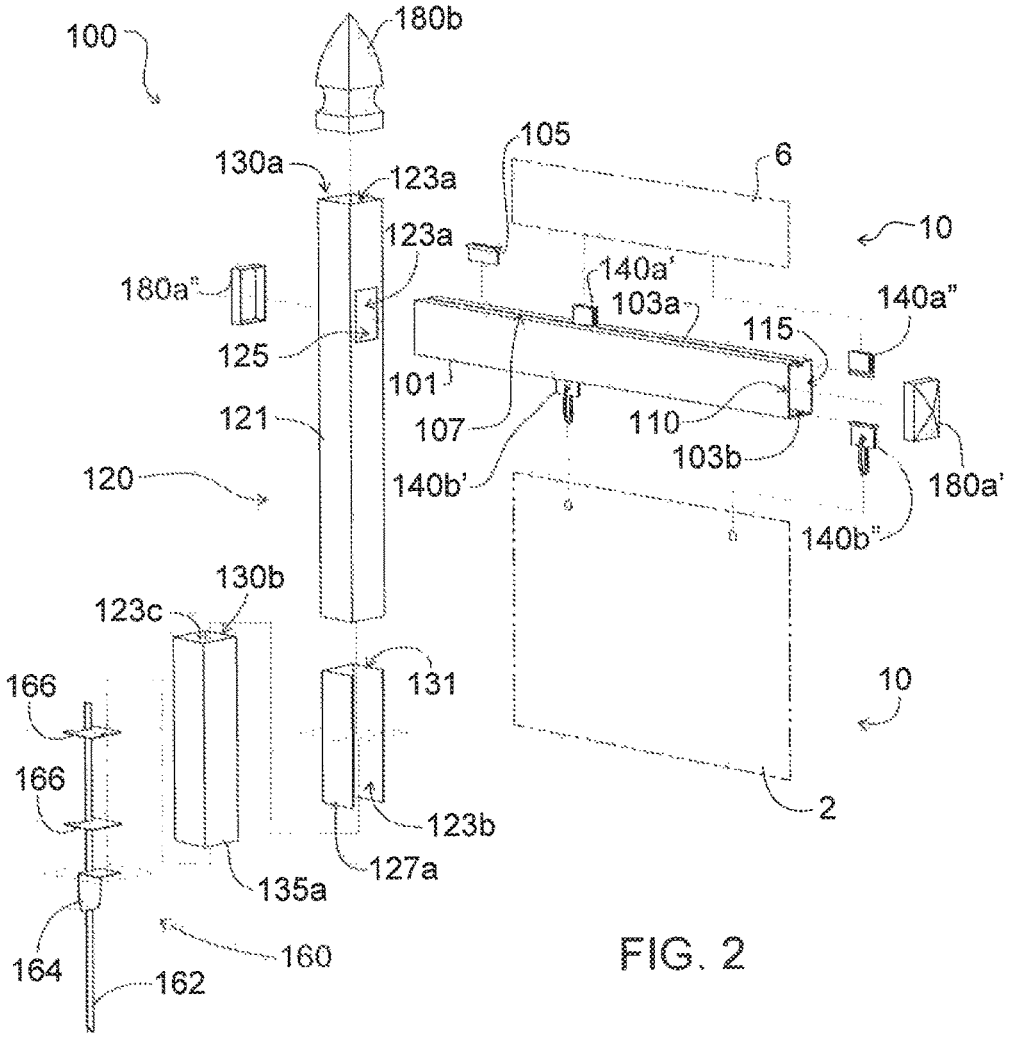
FIG. 2 is an exploded perspective right side view of the assembled signpost of FIG. 1.

Furthermore, in the exemplary embodiment of FIG. 1, the extended arm component 101 is an elongate extrusion-molded component defining a hollow interior 115 (best seen in FIG. 2). The extended arm component 101 is generally defined by a relatively thin, squared cross-section 110 comprising T-shaped channels 103 (best seen in FIG. 2; described in greater detail herein). The extended arm component 101 may be generally defined by various differently shaped cross-sections (e.g., square, rectangular, triangular, circular; depending on the specific embodiment).

Furthermore, in the exemplary embodiment of FIG. 1, the extended arm 101 may be manufactured from affordable and light, yet resilient, composite and/or synthetic materials. In such an embodiment, the extended arm component 101 demands minimal material costs, relative weight, or relative volume. Moreover, despite its thin, elongate structure and the support provided by the semi-modular post sub-system 120, the extended arm component 101 may be configured to resist bending/buckling, due to its weight or the weight of any signage 10, along its length. Moreover, it is envisioned that the extended arm component 101 is a lightweight and easy-to-manipulate component piece that is easily assembled and installed by an end user.

Furthermore, in the exemplary embodiment of FIG. 1, the semi-modular post sub-system 120 is a multi-piece system configured for assembly into an exemplary embodiment of an extendable vertical post. When assembled with the extended arm component 101 and the anchoring component 160 (described in greater detail herein), the semi-modular post sub-system 120 holds in place and supports the extended arm component 101 at a certain height, depending on its extendable height (described in greater detail herein). Moreover, the semi-modular post sub-system 120 receives/bears its own weight and any weight translated from the extended arm component 101.

Furthermore, in the exemplary embodiment of FIG. 1, the semi-modular post sub-system 120 is held in place and supported by the anchoring component 160 such that the assembled signpost 100 remains upright. Moreover, the semi-modular post sub-system 120 engages with the anchoring component 160 such that the semi-modular post sub-system 120 hides the anchoring component 160 as it engages with the supporting substrate.

Furthermore, in the exemplary embodiment of FIG. 1, three-individual pieces make up the semi-modular post sub-system 120 (described in there greater detail herein), although not all embodiments require three individual pieces. More specifically, the exemplary semi-modular post sub-system 120 comprises an exemplary embodiment of an arm-to-post primary sub-component 121, a single extension sub-component 135*a*, and an engagement sub-component 127 (best seen in FIG. 2). One of ordinary skill in the art understands that the semi-modular post sub-system 120 may comprise various other external or internal components/sub-systems.

Furthermore, in the exemplary embodiment of FIG. 1, additional extension sub-components (not shown) may be serially appended off of the arm-to-post primary sub-component 121 via corresponding engagement sub-components (not shown). As such, the assembled semi-modular post sub-system 120 may be configured to adjust the height of the arm-to-post primary sub-component 121 in the assembled signpost 100 and, therefore, the assembled semi-modular post sub-system 120 may be configured to adjust the height of the extended arm component 101.

Furthermore, in the exemplary embodiment of FIG. 1, the arm-to-post primary sub-component 121, the single extension sub-component 135*a*, and the engagement sub-component 127 are elongate extrusion-molded piece defining a hollow interior 123 and a squared shape similar to the extended arm component 101 (best seen in FIG. 2; described in greater detail herein). The extension sub-component(s) 135 and the engagement sub-component(s) 127 are each, respectively, modular as a grouping. The extension sub-components 135 and the arm-to-post primary sub-component 121, as a grouping, may also be modular (i.e., they may be identically shaped and configured). Moreover, the arm-to-post primary sub-component 121, the single extension sub-component 135*a*, and the engagement sub-component 127 are each, respectively, a lightweight and easy-to-manipulate sub-component.

Furthermore, in the exemplary embodiment of FIG. 1, each individual piece of the semi-modular post sub-system 120 may be manufactured from affordable and light, yet resilient, composite and/or synthetic materials. Therefore, the semi-modular post sub-system 120 demands minimal material costs, relative weight, or relative volume. Moreover, despite its thin, elongate structure and the support provided by the anchoring component 160, the semi-modular post sub-system 120 may be configured to resist bending/buckling, due to its support of the extended arm component 101 or the weight of any signage 10.

Furthermore, in the exemplary embodiment of FIG. 1, the sign attachment sub-system 140 is a multi-piece system configured for engagement with the extended arm component 101. When assembled with the extended arm component 101, the sign attachment sub-system 140 holds in place and supports the signage 10 off of the extended arm component 101. Moreover, the sign attachment sub-system 140 is configured for adjustable positioning along the length of the extended arm component 101 (described in greater detail herein).

Furthermore, in the exemplary embodiment of FIG. 1, two types of sign attachment sub-components make up the sign attachment sub-system 140. More specifically, the sign attachment sub-system 140 comprises one exemplary embodiment of rider clips 140*a* and panel clips 140*b* (described in greater detail herein). The types of sign attachment sub-components may, however, be any type known to one having ordinary skill in the art and configured to mechanically engage with a channel 103. Moreover, the rider clips 140*a* and the panel clips 140*b* are held in place and supported along the T-shaped channels 103*a* and 103*b*, respectively, (described in greater detail herein) such that any signage 10 is hung off of, and/or rode on, the extended arm component 101. Additional sign attachment sub-components 140*n* may be engaged to the extended arm component 101 or the semi-modular post sub-system 120.

Furthermore, in the exemplary embodiment of FIG. 1, the rider clips 140*a* and the panel clips 140*b* are molded pieces. The rider clips 140*a* and the panel clips 140*b* are each, respectively, modular as a grouping. The rider clips 140*a* and the panel clips 140*b* are each, respectively, a lightweight and easy-to-manipulate sub-component configured to complement the T-shaped channels 103*a* and/or 103*b*. Moreover, the rider clips 140*a* and the panel clips 140*b* are configured to easily slide along the T-shaped channels 103*a* and/or 103*b*. Notably, although the exemplary embodiment featured in the present disclosure comprises T-shaped channels 103, the scope of the invention is not limited to include T-shaped channels as it is envisioned that channels of different profiles would occur to those of ordinary skill in the art reading the present disclosure. For example, the rider clips 140*a* and the panel clips 140*b* may be configured to engaged with the signpost 100 via any means or method known to one of ordinary skill in the art (e.g., male-female engagement, friction-fit engagement).

Furthermore, in the exemplary embodiment of FIG. 1, each individual piece of the sign attachment sub-system 140 may be manufactured from affordable and light, yet resilient, composite and/or synthetic materials. Therefore, the sign attachment sub-system 140 demands minimal material costs, relative weight, or relative volume.

Furthermore, in the exemplary embodiment of FIG. 1, the anchoring component 160 is an exemplary embodiment of a ground stake (described in greater detail herein). When assembled with the semi-modular post sub-system 120, the anchoring component 160 holds in place, supports, and maintains the vertical orientation of the semi-modular post sub-system 120. Moreover, the anchoring component 160 receives/bears its own weight and any weight translated from the semi-modular post sub-system 120.

Furthermore, in the exemplary embodiment of FIG. 1, the anchoring component 160 detachably engages to/penetrates a supporting substrate such that the assembled signpost 100 remains upright. Moreover, the anchoring component 160 is received by the hollow interior 123*c* of the extension sub-component 135*a* such that the semi-modular post sub-system 120 hides the anchoring component 160 as it engages with/penetrates the supporting substrate.

Furthermore, in the exemplary embodiment of FIG. 1, the anchoring component 160 may be manufactured from affordable and light, yet resilient, composite and/or synthetic materials. Therefore, the anchoring component 160 demands minimal material costs, relative weight, or relative volume. Moreover, the anchoring component 160 is a lightweight and easy-to-manipulate component piece that is inserted into the support substrate by the user's own body weight, for example.

Furthermore, in the exemplary embodiment of FIG. 1, the decorative add-on sub-system 180 is a multi-piece system configured for engagement with the extended arm component 101 and/or the semi-modular post sub-system 120 (described in greater detail herein). When assembled with the extended arm component 101 and/or the semi-modular post sub-system 120, the decorative add-on sub-system 180 makes the assembled signpost 100 look like a classic carved wooden signpost and, therefore, more aesthetically pleasing to a certain intended audience. It is envisioned that the sub-components of the decorative add-on sub-system 180 may be shaped into any other classic/modern ornamental feature or design known to one of ordinary skill in the art.

Furthermore, in the exemplary embodiment of FIG. 1, two types of decorative add-on sub-components make up the decorative add-on sub-system 180. More specifically, the decorative add-on sub-system 180 comprises one exemplary embodiment of pointed, extended arm caps 180*a* and a post finial cap 180*b* (described in greater detail herein). One of ordinary skill in the art understands that the decorative add-on sub-system 180 may comprise various other external or internal components/sub-systems.

Furthermore, in the exemplary embodiment of FIG. 1, the pointed, extended arm caps 180*a* and the post finial cap 180*b* append the end(s) of the extended arm component 101 and the semi-modular post sub-system 120, respectively, such that the hollow interiors 115 and 123 are covered. Moreover, the pointed, extended arm caps 180*a* and the post finial cap 180*b* append the end(s) of the extended arm component 101 and the semi-modular post sub-system 120, respectively, such that these components appear to be complex wood-worked carvings, for example.

Furthermore, in the exemplary embodiment of FIG. 1, the pointed, extended arm caps 180*a* and the post finial cap 180*b* are molded pieces. The pointed, extended arm caps 180*a* and the post finial cap 180*b* are each, respectively, a lightweight and easy-to-manipulate sub-component configured to complement the end(s) of the extended arm component 101 and the semi-modular post sub-system 120, respectively. Moreover, the pointed, extended arm caps 180*a* and the post finial cap 180*b* are configured to easily, detachably engage to the ends via a friction-fit. The pointed, extended arm caps 180*a* and the post finial cap 180*b* may be configured to engaged with the signpost 100 via any means or method known to a person of ordinary skill in the art (e.g., male-female engagement, adhesives).

Furthermore, in the exemplary embodiment of FIG. 1, each individual piece of the decorative add-on sub-system 180 may be manufactured from affordable and light, yet resilient, composite and/or synthetic materials. Therefore, the decorative add-on sub-system 180 demands minimal material costs, relative weight, or relative volume.

Referring now to FIG. 2, FIG. 2 is an exploded perspective right side view of the assembled signpost of FIG. 1. The exemplary embodiment illustrated in FIG. 2 is similar to the exemplary embodiment illustrated in FIG. 1 and, therefore, only the differences between these two exemplary embodiments are described.

As previously stated, the extended arm component, when assembled with the semi-modular post sub-system 120, extends laterally off of the semi-modular post sub-system 120 to form an ∟-shape. More specifically, the extended arm component 101 traverses the arm-to-post primary sub-component 121 via an opening 125.

Furthermore, in the exemplary embodiment of FIGS. 1 and 2, the opening 125 complements the cross-section 110 of the extended arm component 101 such that a user can slidably insert the extended arm component 101 through the arm-to-post primary sub-component 121 and across the hollow interior 123*a*. The opening 125 may be configured as any shape or size known to one of ordinary skill in the art (e.g., square, rectangular, triangular, circular; depending on the specific embodiment). Moreover, depending on how far a user inserts the extended arm component 101 through the arm-to-post primary sub-component 121, the overall shape of the assembled signpost 100 may vary along the spectrum defined by the ∟-shape through the ⊥-shape through the ⅃-shape.

Furthermore, in the exemplary embodiment of FIGS. 1 and 2, the extended arm component, when assembled with the semi-modular post sub-system 120, remains in a fixed position despite heavy loads. More specifically, an engagement key 105, when received by an engagement slot 107 (best seen in FIG. 4; described in greater detail herein), fixes the position of the extended arm component 101 relative to the semi-modular post sub-system 120.

Furthermore, as previously stated, the semi-modular post sub-system 120 holds in place and supports the extended arm component 101 at a certain height. The arm-to-post primary sub-component 121 is detachably engaged to the extension sub-component 135*a* via the engagement sub-component 127*a*. More specifically, one end of the engagement sub-component 127*a* is slipped inside of the hollow interior 123*a* of the arm-to-post primary sub-component 121, and the other end is slipped inside of the hollow interior 123*c* of the extension sub-component 135*a*. This establishes a friction-fit attachment between the sub-components. In this way, the semi-modular post sub-system 120 has an extendable length and, therefore, is configured to adjust the height of the extended arm component 101.

Furthermore, in the exemplary embodiment of FIGS. 1 and 2, the arm-to-post primary sub-component 121 and the extension sub-component 135*a* are elongate extrusion-molded components defining the hollow interior 123*a* and the hollow interior 123*c*, respectively. Each sub-component is defined by a relatively thin, squared cross-section 130*a* and 130*b*, respectively. The arm-to-post primary sub-component 121 and the extension sub-component 135*a* may be defined by various differently shaped cross-sections (e.g., square, rectangular, triangular, circular; depending on the specific embodiment).

Furthermore, in the exemplary embodiment of FIGS. 1 and 2, the engagement sub-component 127*a* is an elongate extrusion-molded component defining the hollow interior 123*b*. The engagement sub-component 127*a* is defined by a relatively thin, ⊔-shaped cross-section 131. The engagement sub-component 127*a* may be defined by various differently shaped cross-sections (e.g., square, rectangular, triangular, circular; depending on the specific embodiment). Moreover, because of the ⊔-shaped cross-section 131, the engagement sub-component 127*a* is configured to readily slip inside of the hollow interior 123*a* of the arm-to-post primary sub-component 121 and the hollow interior 123*c* of the extension sub-component 135*a*. Moreover, because of the ⊔-shaped cross-section 131, a user can easily pinch the engagement sub-component 127*a* to release the friction-fit between it and the arm-to-post primary sub-component 121 and/or the extension sub-component 135*a*.

Furthermore, as previously stated, the sign attachment sub-system 140 holds in place and supports the signage 10 off of the extended arm component 101. Two rider clips 140*a′* and 140*a″* are held in place and supported along the upper T-shaped channel 103*a*. A user can insert/slide the rider clips 140*a′* and 140*a″* into the channel 103*a* via the end(s) of the extended arm component 101 (best seen in FIG. 3; described in greater detail herein). In this way, the rider clips 140*a′* and 140*a″* are configured for adjustable positioning along the length of the extended arm component 101.

Furthermore, in the exemplary embodiment of FIGS. 1 and 2, two panel clips 140*b′* and 140*b″* are held in place and supported along the lower T-shaped channel 103*b*. A user can insert/slide the panel clips 140*b′* and 140*b″* into the channel 103*b* via the end(s) of the extended arm component 101 (best seen in FIG. 3; described in greater detail here). In this way, the panel clips 140*b′* and 140*b″* are configured for adjustable positioning along the length of the extended arm component 101.

Furthermore, as previously stated, the anchoring component 160 holds in place, supports, and maintains the vertical orientation of the semi-modular post sub-system 120. The anchoring component 160, being a ground stake, comprises an exemplary embodiment of a stake body 162, a supporting substrate flange 164, and secondary flanges 166. One of ordinary skill in the art understands that the anchoring component 160 may comprise various other external or internal components/sub-systems.

Furthermore, in the exemplary embodiment of FIGS. 1 and 2, the stake body 162 is an exemplary embodiment of an elongate barb. As such, the stake body 162 is configured for insertion into the supporting substrate so that it is in a vertical orientation for this particular embodiment. Moreover, the supporting substrate flange 164 is a squared flange that extends laterally off of the stake body 162. As such, the supporting substrate flange 164 is configured to engage up against any supporting substrate and prevent any further insertion of the stake body 162 into the supporting substrate. The supporting substrate flange 164 is also configured to prevent tilting over from the vertical position, despite heavy loads. The supporting substrate flange 164, therefore, facilitates the anchoring component 160 rigidly yet detachably engaging with/to the supporting substrate.

Furthermore, in the exemplary embodiment of FIGS. 1 and 2, the secondary flanges 166 are squared flanges positioned serially, higher along the ground stake 162 than the supporting substrate flange 164. The secondary flanges 166 are sufficiently sized for two primary functions. First, the secondary flanges 166 are sufficiently sized to receive a stepping force from a user, for example, such that the ground stake 162 is easily and readily inserted into the supporting substrate up to the supporting substrate flange 164. As such, the anchoring component 160 is configured as a simple-to-install, no-tools-required barb. Second, the secondary flanges 166 are sufficiently sized to complement the squared cross-section 130*b* of the extension sub-component 135. As such, when the anchoring component 160 is received by the hollow interior 123*c*, the secondary flanges 166 fit snuggly within the extension sub-component 135 so as to keep the assembled signpost 100 upright without significant wobble.

Furthermore, as previously stated, the decorative add-on sub-system 180 makes the assembled signpost 100 look like a classic carved wooden signpost. The pointed, extended arm caps 180*a′* and 180*a″* complement the squared cross section 110 of the extended arm component 101 but also have a slightly larger profile. A user can attach the pointed, extended arm caps 180*a′* and 180*a″* to the ends of the extended arm component 101, respectively, via a friction-fit. In this way, the extended arm caps 180*a′* and 180*a″* are configured to detachably cap the ends of the extended arm component 101. Moreover, the pointed, extended arm caps 180*a′* and 180*a″* are configured to cap off the hollow interior 115 and the T-shaped channels 103.

Furthermore, in the exemplary embodiment of FIGS. 1 and 2, the post finial cap 180*b* complements the squared cross section 130*a* of the arm-to-post primary sub-component 121 but also has a slightly larger profile. A user can attach the post finial cap 180*b* to this one end of the arm-to-post primary sub-component 121 via a friction-fit. In this way, the post finial cap 180*b* is configured to detachably cap one end of the arm-to-post primary sub-component 121. Moreover, the post finial cap 180*b* is configured to cap off the hollow interior 123*a* and, therefore, prevent access to the engagement key 105 in this particular embodiment (described in greater detail herein).

Figure 3:
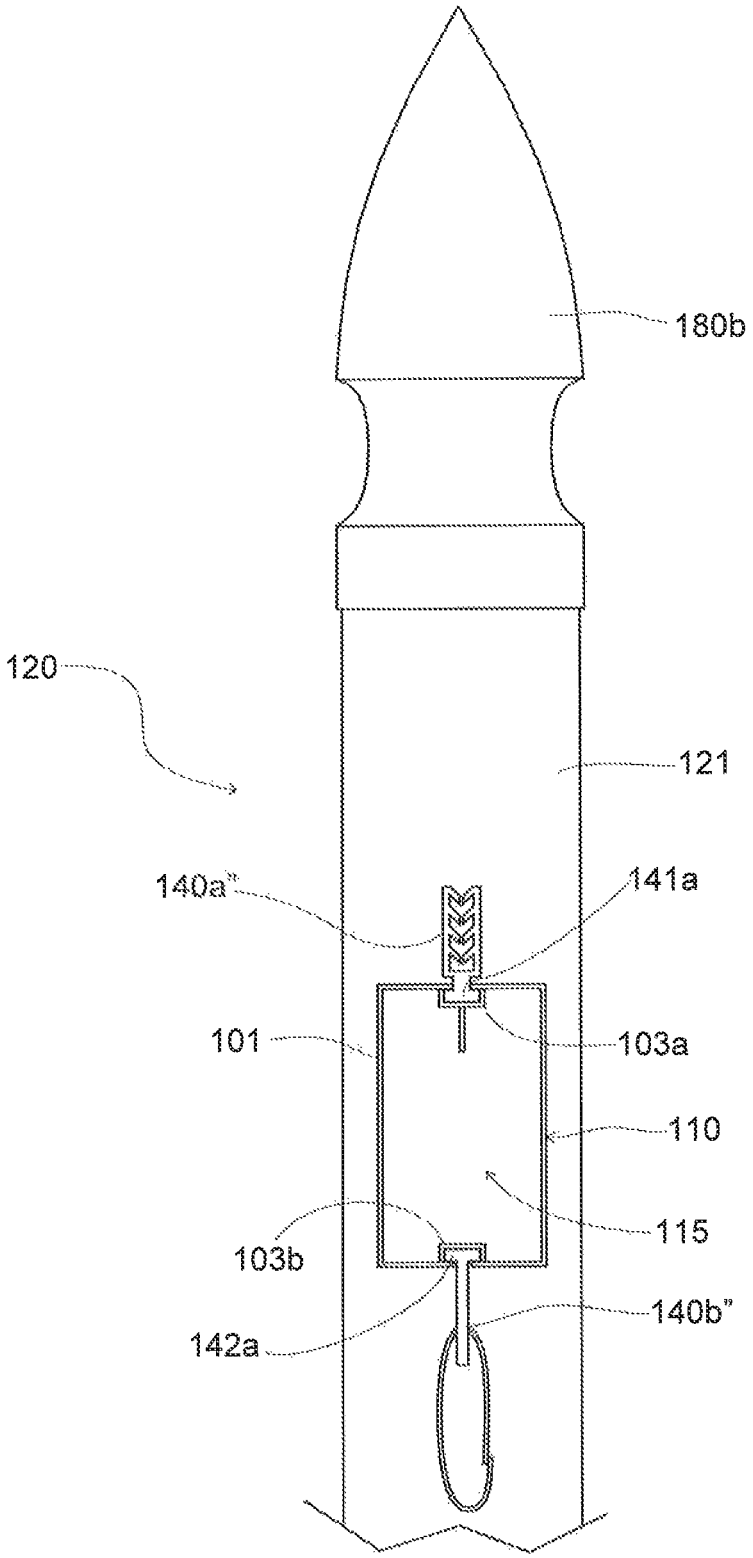
FIG. 3 is a front view of the assembled signpost of FIG. 1 with a pointed, extended arm cap removed.

Referring now to FIG. 3, FIG. 3 is a front view of the assembled signpost of FIG. 1 with a pointed, extended arm cap removed. The exemplary embodiment illustrated in FIG. 3 is similar to the exemplary embodiment illustrated in FIG. 1 and, therefore, only the differences between these two exemplary embodiments are described.

As previously stated, the extended arm component 101 and the sign attachment sub-system 140, via the T-shaped channels 103, adjustably hold in place and support the signage 10. The rider clips 140*a'* and 140*a"* each respectively comprise an engagement end 141 configured to complement the T-shaped channel 103*a*. A user can insert/slide the engagement end 141*a* of the rider clip 140*a*", for example, into the channel 103*a* via the exposed end of the extended arm component 101, when the pointed, extended arm cap 180*a'* is removed. In this way, the rider clip 140*a"* is configured for adjustable positioning along the length of the extended arm component 101. Moreover, the pointed, extended arm cap 180*a'* is configured to cap the T-shaped channel 103*a* and, therefore, prevent inadvertent disengagement of the rider clip 140*a"* from the extended arm component 101.

Furthermore, in the exemplary embodiment of FIGS. 1-3, the panel clips 140*b'* and 140*b"* each respectively comprise an engagement end 142 configured to complement the T-shaped channel 103*b*. A user can insert/slide the engagement end 142*a* of the panel clip 140*b*", for example, into the channel 103*b* via the exposed end of the extended arm component 101, when the pointed, extended arm cap 180*a'* is removed. In this way, the panel clip 140*b"* is configured for easy sliding/adjustable positioning along the length of the extended arm component 101. Moreover, the pointed, extended arm cap 180*a'* is configured to cap the T-shaped channel 103*b* and, therefore, prevent inadvertent disengagement of the panel clip 140*b"* from the extended arm component 101.

Figure 4:
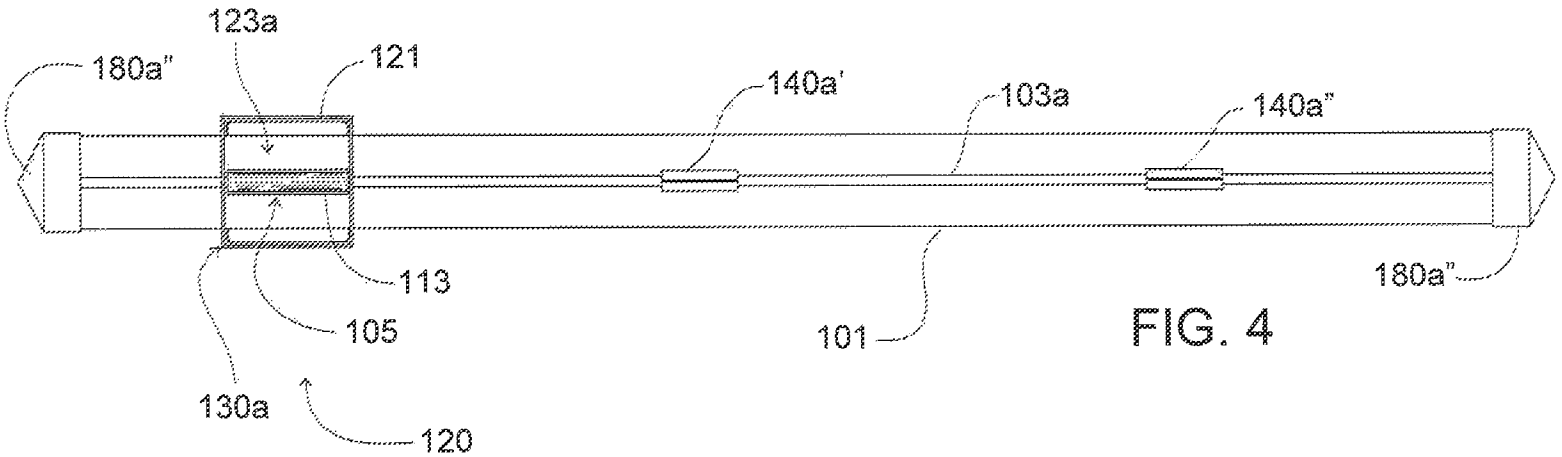
FIG. 4 is a top view of the assembled signpost of FIG. 1 with a finial cap removed.

Referring now to FIG. 4, FIG. 4 is a top view of the assembled signpost of FIG. 1 with a finial cap removed. The exemplary embodiment illustrated in FIG. 4 is similar to the exemplary embodiment illustrated in FIG. 1 and, therefore, only the differences between these two exemplary embodiments are described.

As previously stated, the extended arm component 101 extends laterally off of the semi-modular post sub-system 120 to form an L -shape. More specifically, the extended arm component 101 traverses the arm-to-post primary sub-component 121 of the semi-modular post sub-system 120 via the opening 124 such that the extended arm component 101 extends across the hollow interior 123*a*. The extended arm component 101 remains in this fixed position, despite heavy loads, due to the engagement key 105 being received by the engagement slot 107 within the hollow interior 123*a* of the arm-to-post primary sub-component 121 (best seen in FIG. 5; described in greater detail herein).

Furthermore, in the exemplary embodiment of FIGS. 1-4, the engagement slot 107 (best seen in FIG. 5) is defined by the extended arm component 101 along the T-shaped channel 103*a*. The engagement slot 107 complements the engagement key 105 such that a user can insert the engagement key 105 into the engagement slot 107 (described in greater detail herein). The engagement slot 107 may be configured as any shape or size, and positioned anywhere, known to one of ordinary skill in the art (e.g., square, rectangular, triangular, circular; depending on the specific embodiment of the engagement key 105).

Furthermore, in the exemplary embodiment of FIGS. 1-4, the engagement key 105 is an elongate extrusion-molded T-shaped sub-component. The engagement key 105 comprises one exemplary embodiment of an engagement end 111 (best seen in FIG. 5) and a retention end 113. One of ordinary skill in the art understands that the engagement key 105 may comprise various other external or internal components/sub-systems with various other shapes/configurations. Moreover, the engagement end 105 is configured to complement the shape of the engagement slot 107 such that the engagement end 105 can be inserted into the engagement slot 107.

Furthermore, in the exemplary embodiment of FIGS. 1-4, the engagement key 105 may be manufactured from affordable and light, yet resilient, composite and/or synthetic materials. Therefore, the engagement key 105 demands minimal material costs, relative weight, or relative volume. Moreover, the engagement key 105 is a lightweight and easy-to-manipulate component piece that is easily manipulated by an end user.

Figure 5:
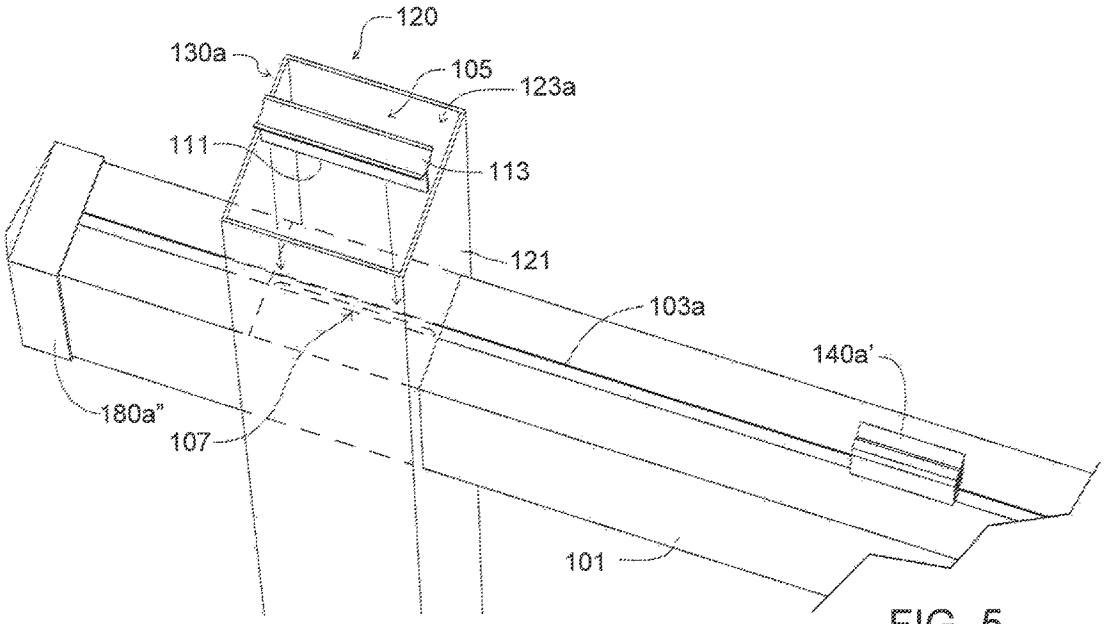
FIG. 5 is a perspective top and right side view of the assembled signpost of FIG. 4.
Figure 6:
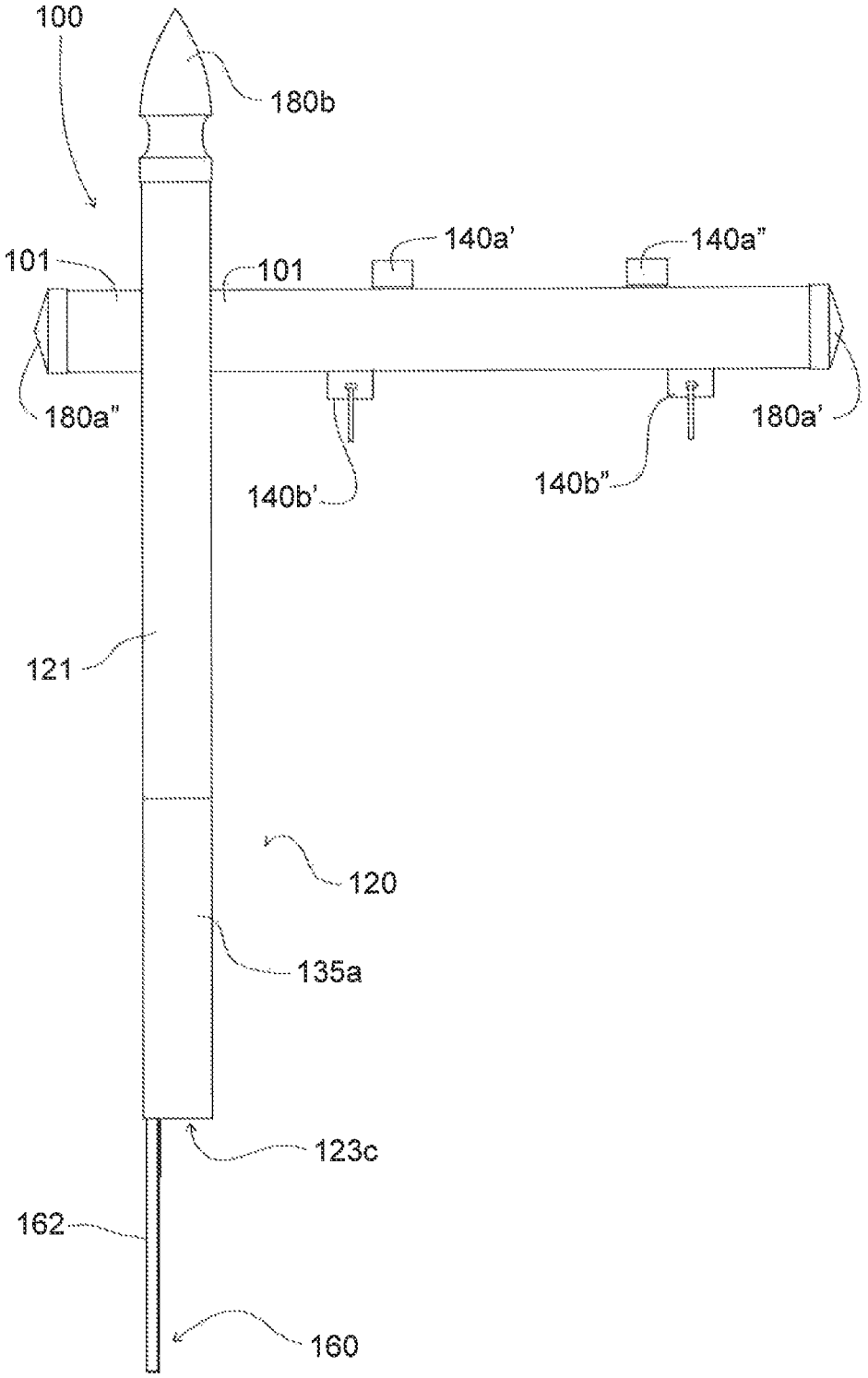
FIG. 6 is a right side view of the assembled signpost of FIG. 1.

Referring now to FIG. 5, FIG. 5 is a perspective top and right side view of the assembled signpost of FIG. 4. The exemplary embodiment illustrated in FIG. 5 is similar to the exemplary embodiment illustrated in FIG. 4 and, therefore, only the differences between these two exemplary embodiments are described.

As previously stated, the engagement key 105 is received by the engagement slot 107 within the hollow interior 123*a* of the arm-to-post primary sub-component 121. More specifically, in this particular embodiment, the assembled signpost 100 demands that the extended arm component 101 traverse the arm-to-post primary sub-component 121 such the engagement slot 107 is positioned/aligned within the hollow interior 123*a*. A user can insert the engagement end 111 into the engagement slot 107 within the hollow interior 123*a* such that the retention end 113 rests on top of the extended arm component 101 along the T-shaped channel 103*a*. In this way, the extended arm component 101 is configured to retain/fix the orientation/alignment of the assembled signpost 100. More specifically, the retention end 113 of the extended arm component 101 is configured to prevent the extended arm component 101 for moving/sliding further through the opening 125 of the arm-to-post primary sub-component 121.

Figure 7:
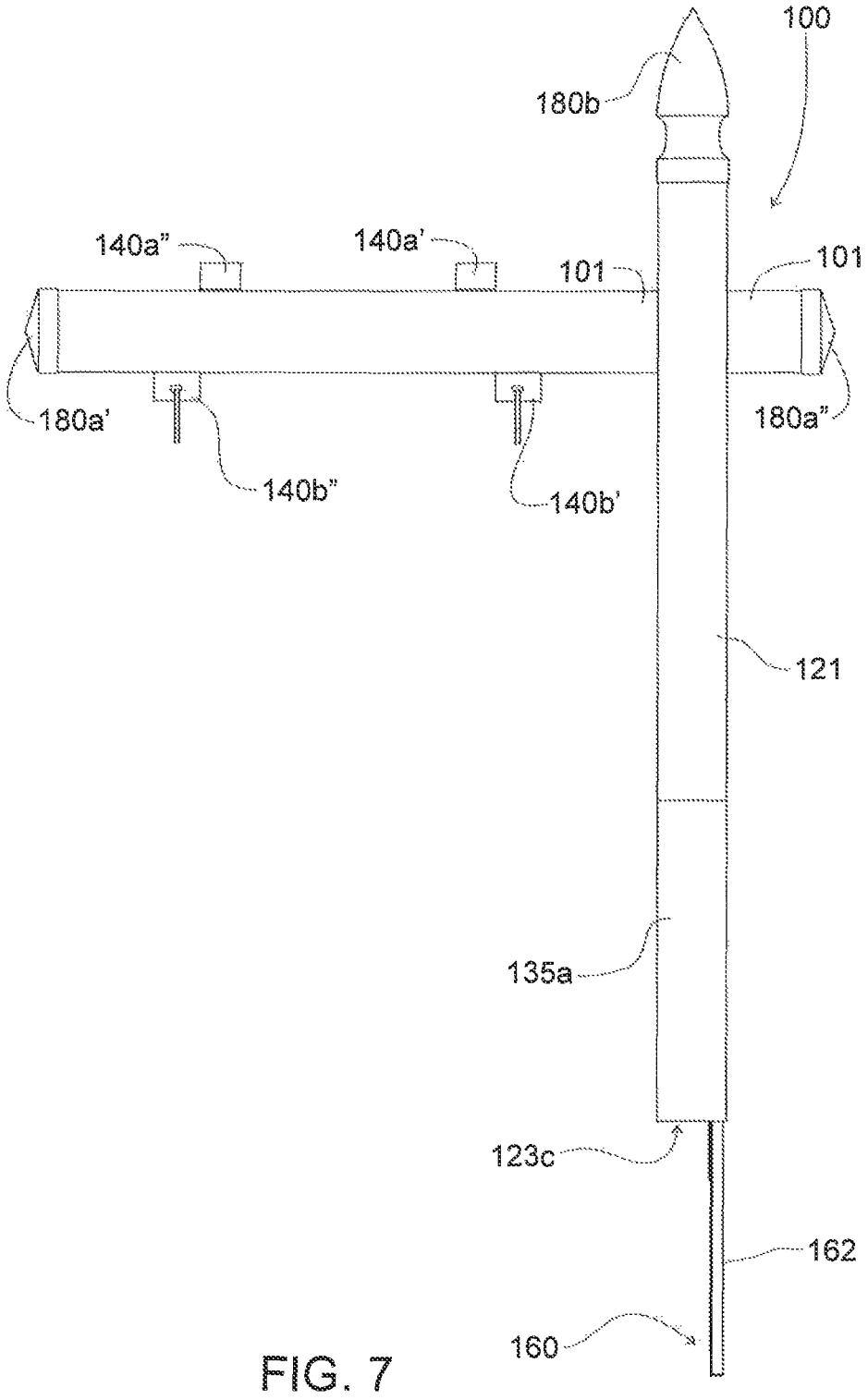
FIG. 7 is a left side view of the assembled signpost of FIG. 1.
Figure 8:
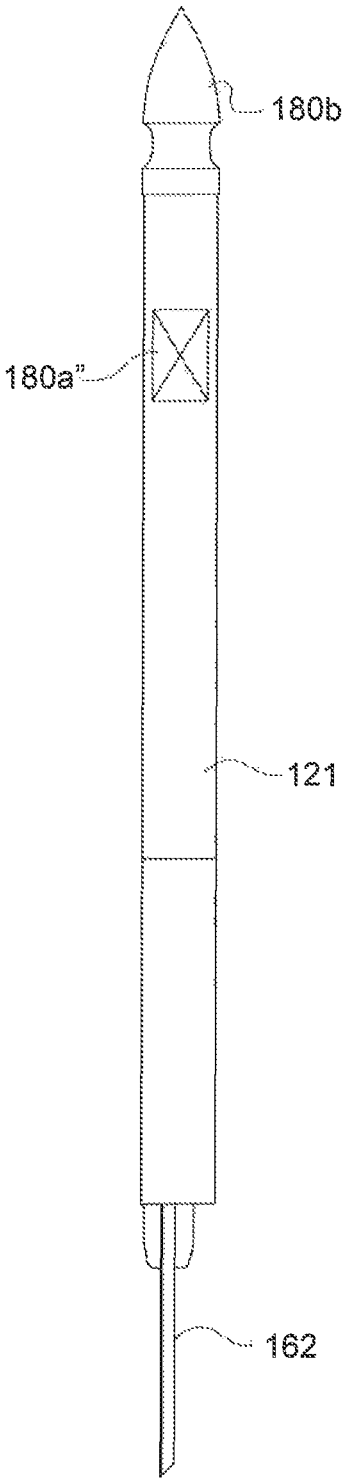
FIG. 8 is a rear view of the assembled signpost of FIG. 1.
Figure 9:
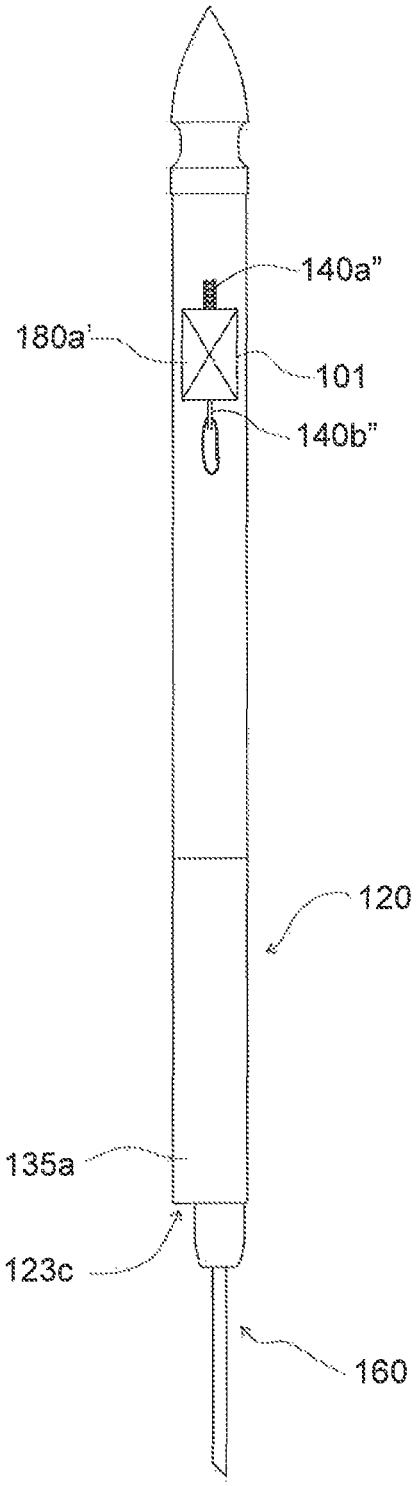
FIG. 9 is a front view of the assembled signpost of FIG. 1.

Referring now to FIGS. 6-9, FIG. 6 is a right side view of the assembled signpost of FIG. 1. FIG. 7 is a left side view of the assembled signpost of FIG. 1. FIG. 8 is a rear view of the assembled signpost of FIG. 1. FIG. 9 is a front view of the assembled signpost of FIG. 1. The exemplary embodiments illustrated in FIGS. 6-9 are similar to the exemplary embodiment illustrated in FIG. 1.

It is envisioned that the components or sub-systems of the assembled signpost 100 may be one contiguous discrete piece that is forged or cast molded. It is also envisioned that the components or sub-systems of the assembled signpost 100 may be a composite of multiple discrete and/or non-discrete sub-component pieces that are permanently and/or detachably engaged with one another. One of ordinary skill in the art recognizes that the components or sub-systems of the assembled signpost 100 may be made of any material(s). One of ordinary skill in the art of manufacturing understands the intricacies and fine details of building and structuring the components or sub-systems of the assembled signpost 100.

It is also envisioned that the components or sub-systems of the assembled signpost 100 may be in and of itself, or superficially lined by, a corrosive resistant material(s) and/or a friction reducing material(s). This is especially true for any region of the components or sub-systems of the assembled signpost 100 that may be in contact with the external environment and/or any other articulable part of the signpost 100. It is also envisioned that the dimensions of the components or sub-systems of the assembled signpost 100 are not limited by what is depicted in the FIGS. One of ordinary skill in the art understands that the components or subsystems of the assembled signpost 100 may be scaled in size for any application or use.

Alternative embodiments for the system and method of the present disclosure will become apparent to one of ordinary skill in the art to which the invention pertains without departing from its spirit and scope. Therefore, although selected aspects have been illustrated and described in detail, it will be understood that various substitutions and alterations may be made therein without departing from the spirit and scope of the present invention, as defined by the following claims.

What is claimed is:

1. A signpost system comprising:

a sign attachment component;

an extended arm component comprising an elongated groove extended along the extended arm component length, the elongated groove configured to receive the sign attachment component such that the relative position of the sign attachment component is adjustable along the length of the extended arm component;

a post component defining a hollow interior and a pair of complimentary openings, the post component configured to receive the extended arm component through the pair of complimentary openings such that a traversing portion of the extended arm component is positioned within the hollow interior, the traversing portion of the extended arm component including an engagement slot located within the elongated groove; and an engagement key comprising an engagement end and a retention end, the engagement end configured to cooperate with the engagement slot within the hollow interior;

wherein, when the post component receives the extended arm component through the pair of complimentary openings such that the traversing portion of the extended arm component is positioned within the hollow interior, and when the engagement end of the engagement key cooperates with the engagement slot that is located within the elongated groove:

the post component supports the extended arm component; and the retention end of the engagement key prevents the extended arm component from displacing relative to the post component.

2. The signpost system of claim 1, additionally comprising:

an anchoring component configured to detachably engage with a supporting substrate;

wherein the post component is additionally configured to receive a portion of the anchoring component into the hollow interior; and wherein, when the post component receives the portion of the anchoring component:

the anchoring component supports the post component in an upright position, and the post component hides the anchoring component from view.

3. The signpost system of claim 1:

wherein the sign attachment component comprises a plurality of clips.

4. The signpost system of claim 1, wherein the post component comprises at least one serially appended extension sub-component configured to increase the length of the post component.

* * * * *